US006613996B2

(12) United States Patent
Lee

(10) Patent No.: US 6,613,996 B2
(45) Date of Patent: Sep. 2, 2003

(54) LOW-NOISE KEY SWITCH AND KEYBOARD THEREOF

(75) Inventor: Tong-Hsueh Lee, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/038,808

(22) Filed: Jan. 8, 2002

(65) Prior Publication Data

US 2003/0127309 A1 Jul. 10, 2003

(51) Int. Cl.[7] ..... H01H 13/70
(52) U.S. Cl. ..... 200/344
(58) Field of Search ..... 200/5 A, 517, 200/341, 344, 345; 400/490, 491.2, 495, 495.1, 496

(56) References Cited

U.S. PATENT DOCUMENTS 5,247,143 A * 9/1993 Suwa ..... 200/517
5,950,810 A * 9/1999 Pan et al. ..... 200/344
5,990,435 A * 11/1999 Chao ..... 200/517
6,137,071 A * 10/2000 Yeh et al. ..... 200/344

* cited by examiner

*Primary Examiner*—Michael Friedhofer
(74) *Attorney, Agent, or Firm*—Nixon Peabody LLP; Donald R. Studebaker

(57) ABSTRACT

A low-noise key switch for computer appliances is disclosed. An embodiment of the key switch includes a cap at least one elastic element, a supporter, a switch, and a base. The cap has a top surface, a bottom surface, and a bottom edge surface. The elastic element is disposed on the bottom edge surface. The supporter supports the cap to perform a movement relative to the base. The switch, responsive to the movement of the cap, selectively turns on. When the cap moves toward the base, the elastic element approaches the base prior to the cap hitting the base. Therefore, the impact of the cap against the base is absorbed by the elastic element leading to the reduction of noise when the key switch is activated.

11 Claims, 4 Drawing Sheets

LOW-NOISE KEY SWITCH AND KEYBOARD THEREOF

BACKGROUND OF THE INVENTION

1. Field of the Invention

The present invention generally relates to a low-noise key switch, and more particularly, to a key switch with an elastic element to absorb impact induced in the operation of the key switch.

2. Description of the Prior Art

As the technology and the information system continuously progress, computers become indispensable to daily activities. Keyboard is commonly utilized in different kinds of equipment, including computers, as input device.

A keyboard typically includes a base. A plurality of key switches are disposed on the base. Each key switch generally includes a key cap supporting by a resilient member, such that the key switch performs a movement relative to the base. The key cap, when struck by user, moves toward the base. The resilient member, responsive to the movement of key cap, is deformed to activate a corresponding circuit. Therefore, a signal is generated to accomplish the input operation.

In general, a supporter is disposed under the key cap to uniformly distribute a downward pushing force applied to the cap. Particularly, when the reduction of height of a keyboard for portable equipment, such as notebook computer, is extremely demanding, a scissor-like supporter is commonly used to serve the purpose.

However, when the key cap is moved vertically relative to the base, noises tend to be produced due to impact of the key cap toward the base. In pursuit of a low-noise working environment, it is a desire to provide a key switch and a keyboard diminishing noise during operation.

SUMMARY OF THE INVENTION

The present invention is directed toward a low-noise key switch. The present invention introduces an elastic element to absorb induced impact, when the key switch is activated, leading to the reduction of noise.

In accordance with the present invention, the key switch includes a cap, a supporter, a switch, at least one elastic element, and a base. The switch, disposed on the base, further includes a membrane switch and an actuator. The actuator includes a resilient member disposed on the membrane switch.

The cap has a top surface, an inner bottom surface, and a bottom edge surface. A first connecting portion is disposed on the inner bottom surface of the cap. A second connecting portion is disposed on the base. The supporter has a first end connected to the first connecting portion of the cap and a second end connected to the second connecting portion of the base. Thus, the supporter supports the cap to selectively perform a movement relative to the base. The switch, responsive to the movement of the cap, selectively turns on. In other words, the resilient member is deformed responsive to the movement of the cap and actuates the membrane switch to turn on the switch.

In accordance with a first embodiment, a plurality of the elastic elements is disposed on the bottom edge surface. When the cap moves toward the base, the elastic elements approach the base prior to the cap hits the base. Therefore, impact of the cap toward the base is absorbed by the elastic elements. The key switch of the first embodiment further includes an extra elastic element. The extra elastic element is disposed, corresponding to the bottom edge surface, on the base.

In a second embodiment, a plurality of the elastic elements is disposed on the base corresponding to the bottom edge surface of the cap. When the cap moves toward the base, the cap approaches the elastic elements prior to the cap hits the base. Therefore, impact of the cap toward the base is absorbed by the elastic elements. The key switch of the second embodiment further includes an extra elastic element. The extra elastic element is disposed on the bottom edge surface.

In a third embodiment, a plurality of the elastic elements is disposed on the base corresponding to the bottom edge surface of the cap and the bottom edge surface of the cap, respectively. When the cap moves toward the base, the elastic elements approach each other prior to the cap hits the base. Therefore, impact of the cap toward the base is absorbed by the elastic elements.

The present invention also provides a keyboard including a key switch recited in the first, the second, or the third embodiment.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Embodiments of the invention will now be described in greater detail as follows.

In accordance with the present invention, a low-noise key switch for computer keyboards is provided. The present invention introduces an elastic element to absorb induced impact, when the key switch is activated, leading to the reduction of noise.

Figure 1A:
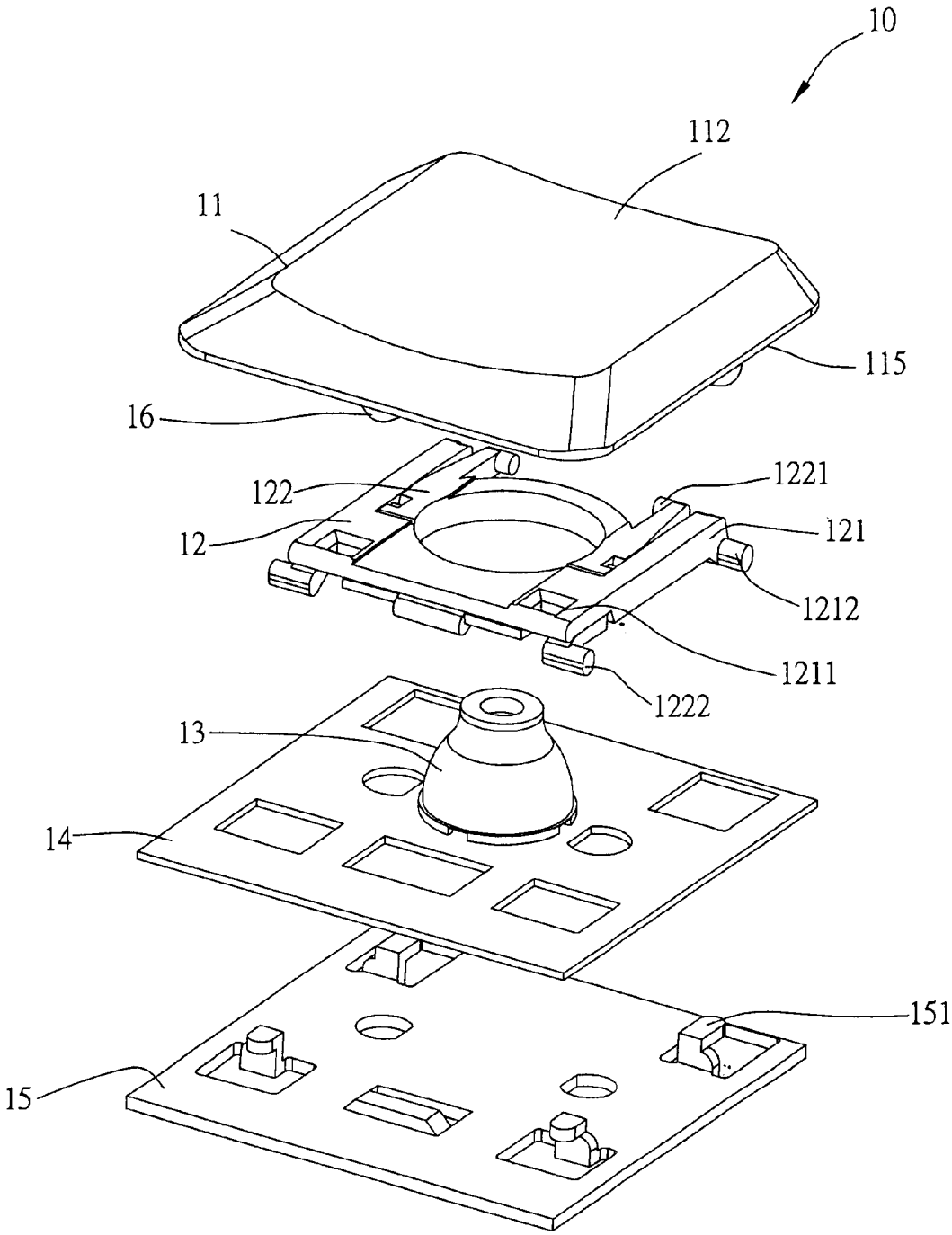
FIG. 1A is an exploded view of key switch 10 in the first embodiment of the present invention.
Figure 1B:
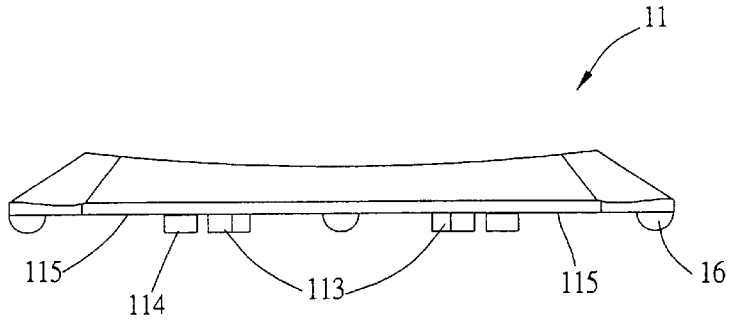
FIG. 1B is a lateral view of the cap 11 of the key switch 10 in FIG. 1.
Figure 1C:
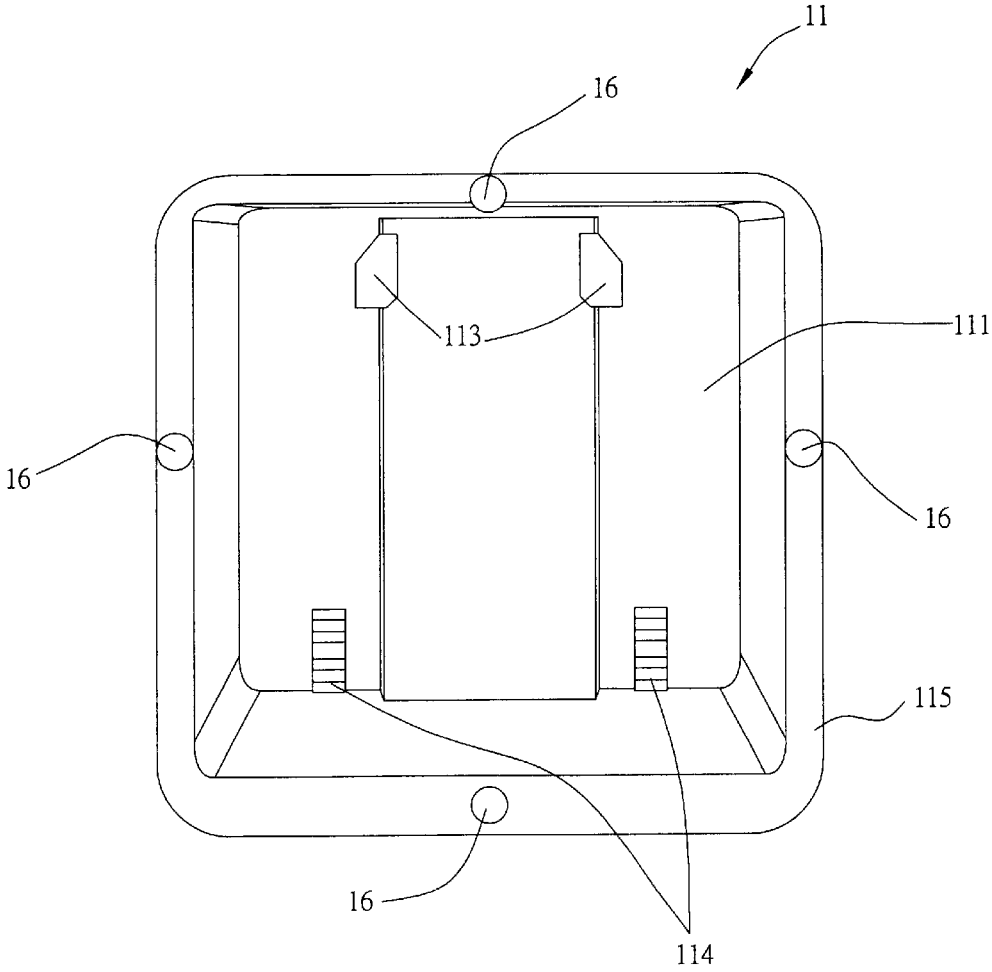
FIG. 1C is a schematic bottom view of the cap 11 of the key switch 10 in FIG. 1.

Referring to FIG. 1A, FIG. 1B, and FIG. 1C, in the first embodiment of the present invention, a low-noise key switch 10 for computer appliances is provided. As shown in FIG. 1A, the key switch 10 includes a cap 11, a supporter 12, a switch, at least one elastic element 16, and a base 15. The switch, responsive to movement of the cap 11, selectively turns on. The switch includes a membrane switch 14 and an actuator including a resilient member 13.

The cap 11 has an inner bottom surface 111, a top surface 112, and a bottom edge surface 115. A connecting portion is disposed on the inner bottom surface 111 of the cap 11. The connecting portion includes a first retaining pair 113 and a second retaining pair 114. Similarly, a plurality of retainers 151 in reversed-L shape constitutes a connecting portion of the base 15.

The supporter 12 supports the cap 11 to perform a movement relative to the base 15. In this embodiment, the supporter is a conventional scissor-like supporter which has two linking members, 121 and 122, as shown in FIG. 1. These two linking members 121, 122 are movably and rotatably interlocked with each other. The linking members (121, 122) have a first end 1211, 1221 and a second end 1212, 1222, respectively. The first ends, 1211 and 1221, are connected to the connecting portion (113 and 114) of the cap 11. The second ends, 1212 and 1222, are connected to the connecting portion of the base 15. Thus, the supporter 12 supports the cap 11 to perform a movement relative to the base 15.

The membrane switch 14 is provided on the base 15 and the resilient member 13 on the membrane switch 14. When the cap 11 moves toward the base 15, the resilient member 13 is deformed and actuates the membrane switch 14 to turn on the key switch 10. When the pushing force applied to the cap 11 is released, the resilient member 13 is elastically restored. Therefore, the cap 11 returns to the initial position and the key switch 10 turns off.

The key aspect of this embodiment is at least one elastic element 16 provided on the bottom edge surface 115 of the cap 11. As illustrated in FIG. 1B and FIG. 1C, four elastic elements are disposed on the bottom edge surface 115 respectively. When the cap 11 is pressed toward the base 15, the elastic elements 16 approach the membrane switch 14 prior to the cap 11 hits the base 15. Therefore, impact of the cap 11 toward the base 15 is absorbed by the elastic elements 16 leading to the reduction of noise. The key switch of the first embodiment further includes an extra elastic element. The extra elastic element is disposed, corresponding to the bottom edge surface, on the membrane switch.

Figure 2:
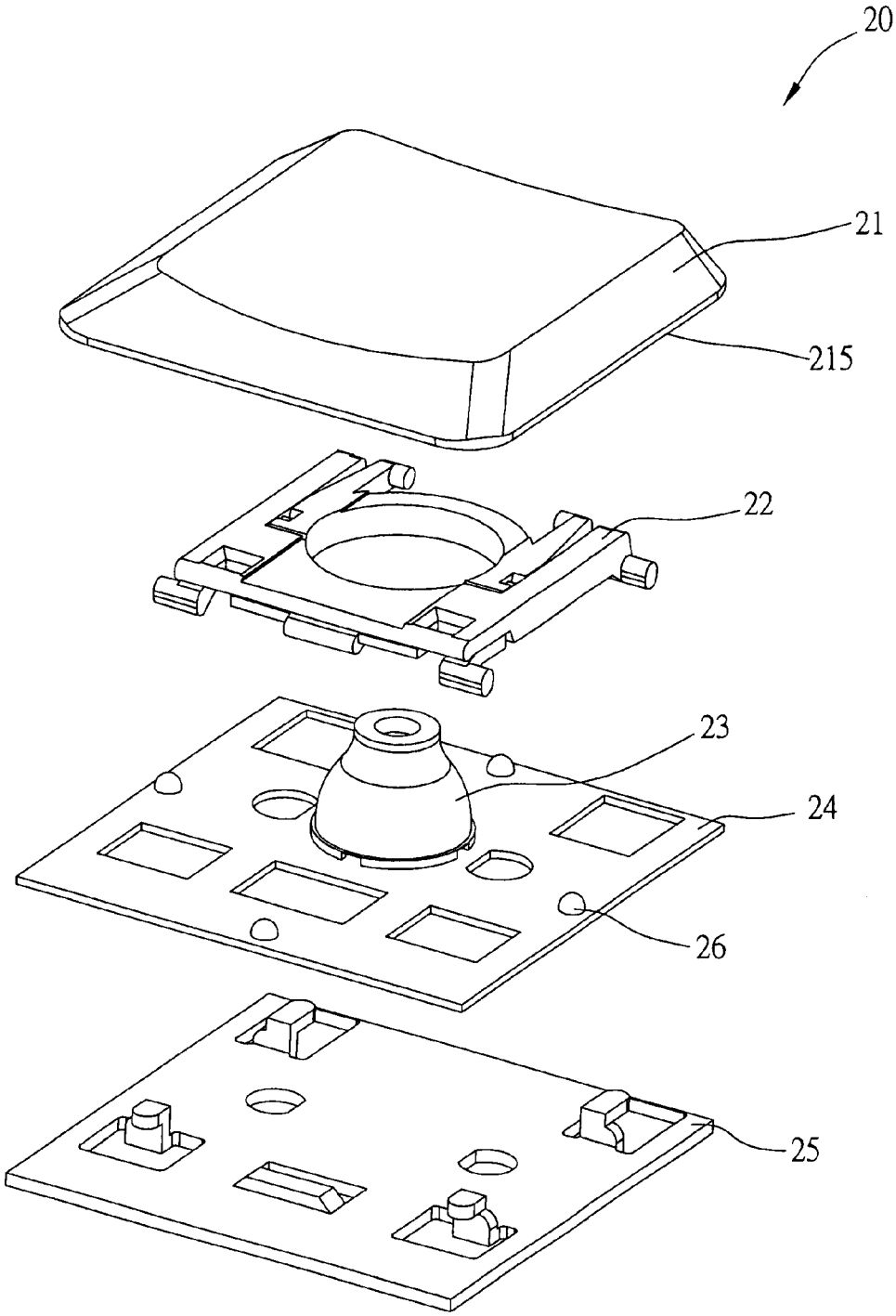
FIG. 2 is an exploded view of key switch 20 in the second embodiment of the present invention.

Referring to FIG. 2, in the second embodiment, a low-noise key switch 20 includes a cap 21, a supporter 22, a resilient member 23, a membrane switch 24, at least one elastic element 26, and a base 25. Each component of the key switch 20 has configuration similar to that in the first embodiment, and functions in a similar way. For the purpose of the simplicity, the relation between each component of the key switch 20 does not repeatedly explain. The key aspect of the second embodiment is that a plurality of the elastic elements 26 is disposed on the membrane switch 24 corresponding to the bottom edge surface 215 of the cap 21. When the cap 21 moves toward the base 25, the cap 21 approaches the elastic elements 26 prior to the cap 21 hits the base 25. Therefore, impact of the cap 21 toward the base 25 is absorbed by the elastic elements 26 leading to the reduction of noise. The key switch of the second embodiment further includes an extra elastic element. The extra elastic element is disposed on the bottom edge surface.

Figure 3:
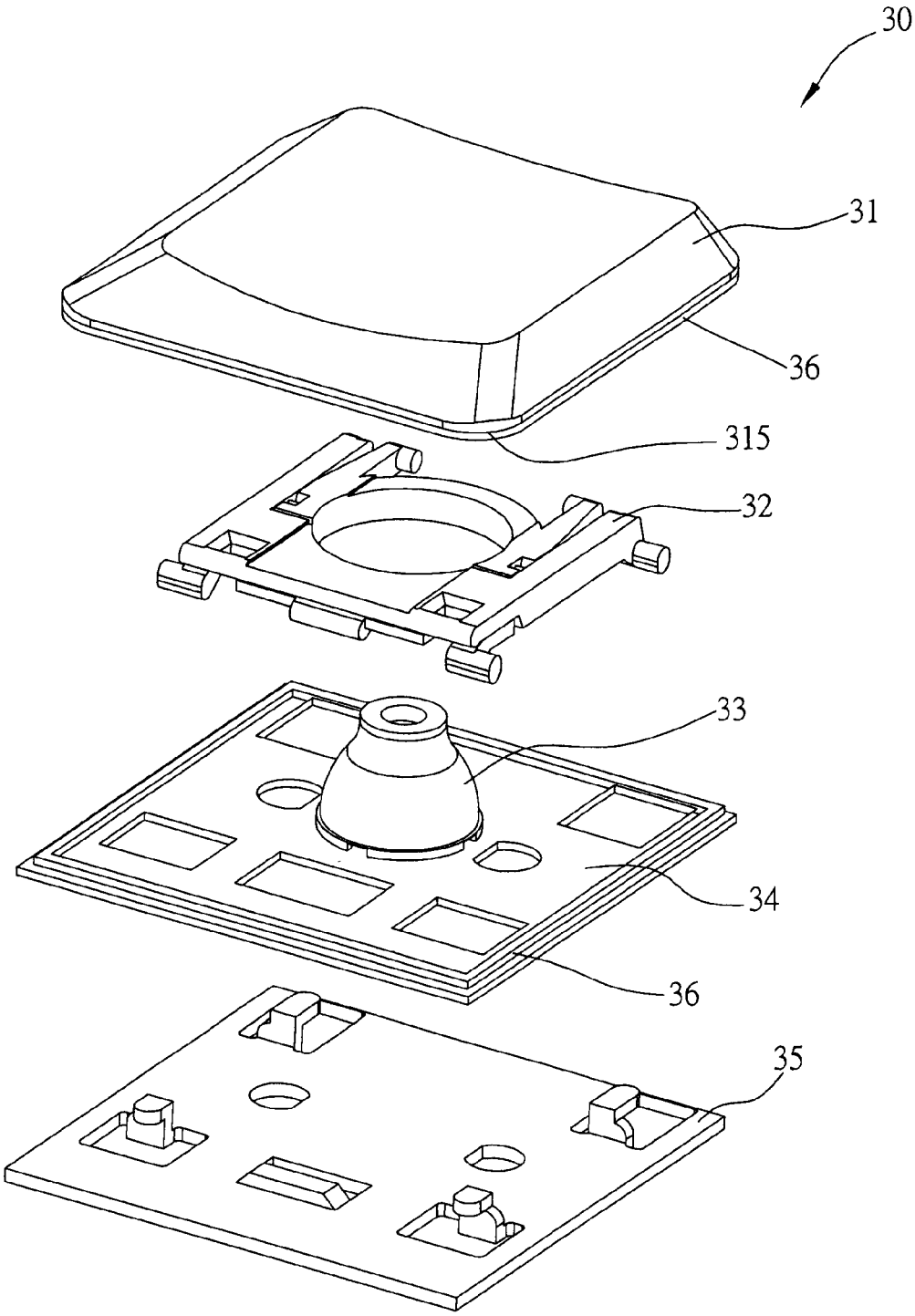
FIG. 3 is an exploded view of key switch 30 in the third embodiment of the present invention.

In the third embodiment, referring to FIG. 3, a low-noise key switch 30 includes a cap 31, a supporter 32, a resilient member 33, a membrane switch 34, a base 35, and two elastic elements 36. Each component of the key switch 30 has configuration similar to that in the first embodiment, and functions in a similar way. For the purpose of the simplicity, the relation between each component of the key switch 30 does not repeatedly explain. The key aspect of the third embodiment is that the two elastic elements 36 are disposed on the bottom edge surface 315 and the membrane switch 34 corresponding to the bottom edge surface 315 of the cap 31, respectively. When the cap 31 moves toward the base 35, the elastic element 36 on the bottom edge surface 315 approaches the elastic element 36 on the membrane switch 24 prior to the cap 31 hits the base 35. Therefore, impact of the cap 31 toward the base 35 is absorbed by the two elastic elements 36 leading to the reduction of noise.

Additionally, the elastic element, according to the need, is designed in different shape such as protrusion, block, or strip. As shown in FIG. 1C and FIG. 2, the elastic element is disposed on a portion of the bottom edge surface, or on a portion of the membrane switch corresponding to the bottom edge surface. As shown in FIG. 3, the elastic element is disposed on the whole bottom edge surface, or on the membrane switch corresponding to the bottom edge surface. Moreover, the elastic element disposed on the base is still in the scope of the present invention.

In accordance with the present invention, a keyboard including a key switch recited in the first, the second, and the third embodiment is also provided.

Although specific embodiments have been illustrated and described, it will be obvious to those skilled in the art that various modifications may be made without departing from what is intended to be limited solely by the appended claims.

What is claimed is:

1. A key switch comprising:

a cap having an inner bottom surface and a bottom edge surface;

at least one elastic element on said bottom edge surface;

a supporter;

a switch; and a base, wherein said supporter supports said cap to selectively perform a movement relative to said base; said switch, responsive to said movement of said cap, selectively turns on; and said elastic element approaches said base prior to said cap hitting said base so that impact of said cap against said base is absorbed by said elastic element when said cap moves toward said base.

2. The key switch according to claim 1, wherein said switch comprises:

a membrane switch being disposed on said base; and an actuator, comprising a resilient member, disposed on said membrane switch, said resilient member being deformed responsive to said movement of said cap and actuating said membrane switch to turn on said switch.

3. The key switch according to claim 2, wherein said cap has a first connecting portion on said inner bottom surface, said base has a second connecting portion, said supporter comprises a first end connected to said first connecting portion and a second end connected to said second connecting portion.

4. The key switch according to claim 3, wherein said supporter is a scissor-like supporter comprising two linking members movably interlocked with each other.

5. The key switch according to claim 2, further comprising an extra elastic element disposed on said membrane switch corresponding to said bottom edge surface.

6. A keyboard comprising a key switch recited in claim 1.

7. A key switch comprising:

a cap having an inner bottom surface and a bottom edge surface;

a supporter;

a membrane switch;

a base; and two elastic elements being disposed on said bottom edge surface and on said membrane switch corresponding to said bottom edge surface respectively, wherein said supporter supports said cap to selectively perform a movement relative to said base; said membrane switch, responsive to said movement of said cap, selectively turns on; and said two elastic elements approaches each other prior to said cap hitting said base so that impact of said cap against said base is absorbed by said two elastic elements when said cap moves toward said base.

8. The key switch according to claim 7, wherein said key switch comprises an actuator, including a resilient member, disposed on said membrane switch, said resilient member being deformed responsive to said movement of said cap to turn on said membrane switch.

9. The key switch according to claim 7, wherein said cap has a first connecting portion on said inner bottom surface, said base has a second connecting portion, and said supporter has a first end connected to said first connecting portion and a second end connected to said second connecting portion.

10. The key switch according to claim 9, wherein said supporter is a scissor-like supporter comprising two linking members movably interlocked with each other.

11. A keyboard comprising a key switch recited in claim 7.

* * * * *